US008813463B2

(12) United States Patent
Berte

(10) Patent No.: US 8,813,463 B2
(45) Date of Patent: Aug. 26, 2014

(54) RECYCLABLE CONTAINERS AND MANUFACTURING METHOD FOR CONTROLLING THE CONTAINER VALUE TO MAXIMIZE CONTAINER RECYCLING

(76) Inventor: Allen J. Berte, Algona, IA (US)

( * ) Notice: Subject to any disclaimer, the term of this patent is extended or adjusted under 35 U.S.C. 154(b) by 152 days.

(21) Appl. No.: 13/194,544

(22) Filed: Jul. 29, 2011

(65) Prior Publication Data

US 2013/0025241 A1 Jan. 31, 2013

(51) Int. Cl.
*B65B 3/02* (2006.01)

(52) U.S. Cl.
CPC ..... *B65B 3/02* (2013.01)
USPC ..... 53/452; 53/410

(58) Field of Classification Search
None
See application file for complete search history.

(56) References Cited

U.S. PATENT DOCUMENTS 5,400,573 A * 3/1995 Crystal et al. ..... 53/468
5,845,682 A * 12/1998 Hayao ..... 141/18
6,618,644 B2 * 9/2003 Bean ..... 700/231
2003/0120380 A1 * 6/2003 Bean ..... 700/231
2006/0117709 A1 * 6/2006 Niggemann et al. ..... 53/410
2006/0167580 A1 * 7/2006 Whittier ..... 700/116
2007/0276686 A1 * 11/2007 Hunscher et al. ..... 705/1
2008/0041996 A1 * 2/2008 Shaw et al. ..... 241/236
2008/0197056 A1 * 8/2008 Kenny ..... 209/644
2009/0007525 A1 * 1/2009 Lewis et al. ..... 53/474
2009/0267740 A1 * 10/2009 Pizzuto ..... 340/10.1
2010/0063887 A1 * 3/2010 Kranz et al. ..... 705/17
2010/0101661 A1 * 4/2010 Hamm et al. ..... 137/223
2010/0152311 A1 * 6/2010 Booth et al. ..... 521/48
2010/0153220 A1 * 6/2010 Hamm ..... 705/16
2010/0222917 A1 * 9/2010 Bohlig et al. ..... 700/224
2010/0332341 A1 * 12/2010 Rost ..... 705/26
2011/0000402 A1 * 1/2011 Grasso, Jr. ..... 106/713
2011/0137812 A1 * 6/2011 Sherga ..... 705/317

* cited by examiner

*Primary Examiner* — Stephen F Gerrity
*Assistant Examiner* — Eyamindae Jallow
(74) *Attorney, Agent, or Firm* — McKee, Voorhees & Sease

(57) ABSTRACT

A recycle container of metal or plastic includes sufficient material of a value that will provide a monetary incentive to the user to recycle the container. Supplemental material may be added to the exterior of the container such as the bottom and/or side wall. The supplemental material may also be placed in the container.

12 Claims, 4 Drawing Sheets

RECYCLABLE CONTAINERS AND MANUFACTURING METHOD FOR CONTROLLING THE CONTAINER VALUE TO MAXIMIZE CONTAINER RECYCLING

BACKGROUND OF THE INVENTION

Landfills throughout the world contain substantial numbers of containers manufactured from materials that would be recycled if the consumer had sufficient motivation to do so. Some states and cities have legislated a fixed redemption value for the container. The value of the container needs to fluctuate such that the consumer is provided with sufficient motivation to return the container to be recycled.

SUMMARY OF THE INVENTION

The manufacturer determines the market value of the container that will provide sufficient incentive for the consumer to recycle the container. The manufacturer then determines the amount of the material used for manufacture of the container to provide the required incentive. The container is then manufactured from the material chosen and filled with a consumer product. The product in the container is then acquired by the consumer and when the container is empty, it will be returned to a recycling center for payment based on the value of the container material.

The value of the container can be varied in numerous different ways including, choice of material, thickness of the container walls and through the use of supplemental materials added to the container, such as ingots. The use of an ingot is to increase the value of the recyclable container. The ingots can be attached to the containers during or after the container manufacturing process. The ingots can be made of any type of valued material, such as the material of conventional containers, including aluminum and plastic. The ingot may be of a dissimilar material to that used in the container. The object is to add materials which are friendly to the recycle process. These ingots will increase the container's value and will encourage voluntary recycling.

The ingot can also have a secondary value as well, such as strengthening containers, protecting them, insulating them, helping containers stay hot or cold longer, or helping them stay upright. The ingots may have basic information stamped on them or have barcodes applied to them. The ingots can be color coded to aide in sorting recyclable materials. The most important object is the recyclable value for the consumer user of the containers.

The ingot label may have the date of manufacture, the weight of the container and ingot, and the American National Standard Institute code for materials (ANSI) information, as well as its recyclable value at the time of manufacture. The ingot is dynamic in that it can easily adapt to the fluctuating market value of materials just by changing its thickness, size, and mass. The ingot can be changed without changing the container.

Ingots can be attached by tape, soddering, glue, heat, press fit, interference fit, collar fit, shrink fit, vacuum fit, or zip tied. The ingots can be put anywhere on or in the container. Ingots can be any size or shape. The main purpose of the ingot is to increase the container's recyclable value.

The ingots are used to increase the intrinsic value of the beverage container to encourage voluntary recycling. They can help keep the beverage cool longer too. These ingots may have the same composition of the container. They can be of different materials also, as long as it is friendly to the recyclable process. The most important thing is to have the recyclable value of the container or ingot visible to the user.

The label or stamp and barcode should have the ANSI material composition number, weight, date and current recyclable value. This feature can be adapted to all types of containers. This information can be stamped and/or barcoded on labels. This technique can be applied to large containers such as barrels, jugs and chemical containers. This will encourage the voluntary recycling by enhancing intrinsic value of empty containers.

The ingots are used to increase the intrinsic value of the containers. The ingots can be made of the same material of the container. The ingots should have the: ANSI composition, weight, date, and recyclable value easily identifiable to the user. The ingots can also be color coded for easy sorting in the recyclable process. The ingots can be made of dissimilar materials as well, as long as they are friendly to the recyclable process.

Ingots can easily adapt to the fluctuations in markets by increasing or decreasing their size, thickness and weights without changing the original manufacturing process of the containers. Ingots can be attached by tape, glue, sodder, welding, interference fit, vacuum fit, heat, shrink fitting, or zip tied to the container. Ingots can be in the containers also.

The main purpose of the ingot is to encourage voluntary recycling by enhancing the intrinsic value of empty used containers. It will save money on landfills. It will help clean up the countryside, help save in processing of raw materials, prevent trash in streams, rivers, and oceans, and help in the recycling of valuable commodities, such as aluminum, plastic, glass, and steel. The ingot is simple and dynamic in its encouragement of voluntary recycling of precious raw materials and the preservation of the environment.

DETAILED DESCRIPTION OF THE PREFERRED EMBODIMENTS

The preferred embodiment of this invention is shown in FIGS. 1A-FIG. 6B wherein an ingot of supplemental material is attached to the bottom of the container which may be metal or plastic. The containers illustrated are of conventional construction found in drink containers for soft drinks or beer found in retail stores.

Figure 1A:
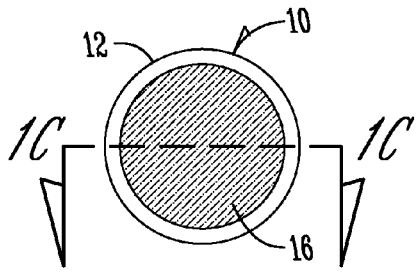
FIG. 1A is a bottom view of a container having a round bowl ingot on the bottom wall.
Figure 1B:
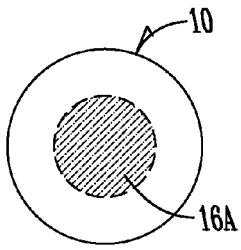
FIGS. 1B is a view similar to FIG. 1A showing a smaller round bowl and ingot.
Figure 1C:
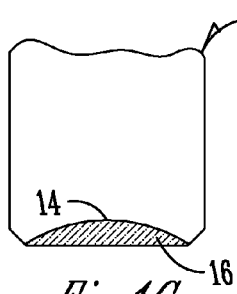
FIG. 1C is a cross-sectional view taken along line 1C in FIG. 1A.

The container 10 in FIGS. 1A, 1B and 1C includes a side wall 12 and a bottom wall 14 to which a round bowl ingot 16 is attached by glue or other conventional bonding means. The ingot 16A in FIG. 1B is of a smaller size to illustrate that the ingot size can vary as needed to provide the desired material value for motivating recycling of the container.

Figure 2A:
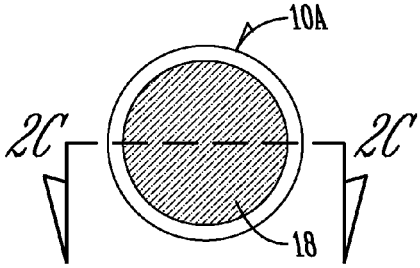
FIG. 2A is a bottom view of a container having a round flat ingot on the bottom wall.
Figure 2B:
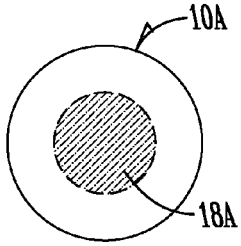
FIG. 2B is a view similar to FIG. 2A showing a smaller round flat ingot.
Figure 2C:
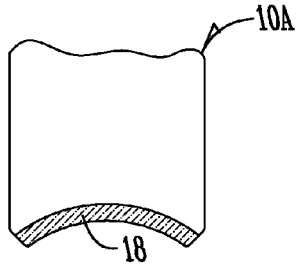
FIG. 2C is a cross-sectional view taken along the line 2C in FIG. 2A.

FIGS. 2A, 2B and 2C show a container 10A having a smaller round flat ingot 18 with the ingot 18A in FIG. 2B being smaller yet in size.

Figure 3A:
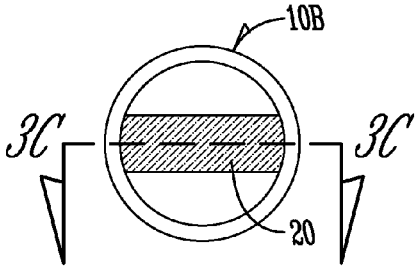
FIG. 3A is a bottom view of a container having a rectilinear bowl ingot.
Figure 3B:
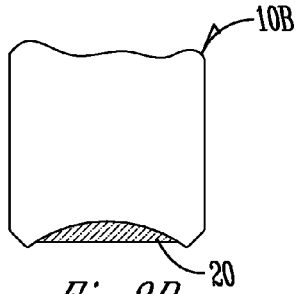
FIG. 3B is a cross-sectional view taken along line 3B in FIG. 3A.

The container 10B in FIGS. 3A and 3B includes a rectilinear bowl ingot 20.

Figure 4A:
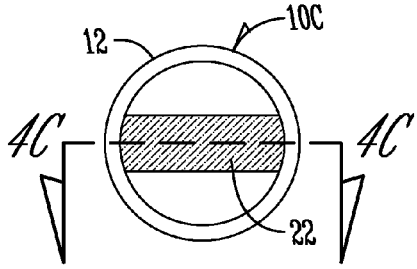
FIG. 4A is a bottom view of a container having a flat rectilinear bowl ingot on the bottom wall.
Figure 4B:
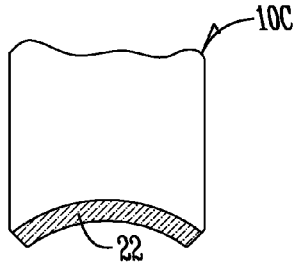
FIG. 4B is a cross-sectional view taken along the line 4B in FIG. 4A.

The container 10C in FIGS. 4A and 4B includes a flat rectilinear bowl ingot 22.

Figure 5A:
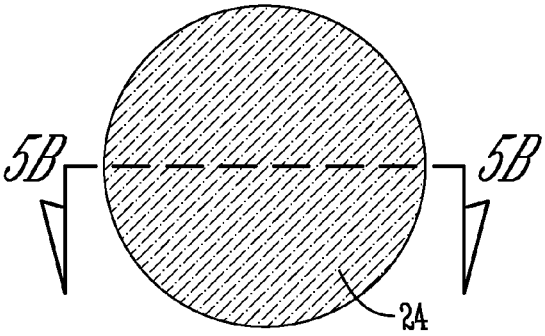
FIG. 5A is a bottom view of a container having a cup type cover ingot.
Figure 5B:
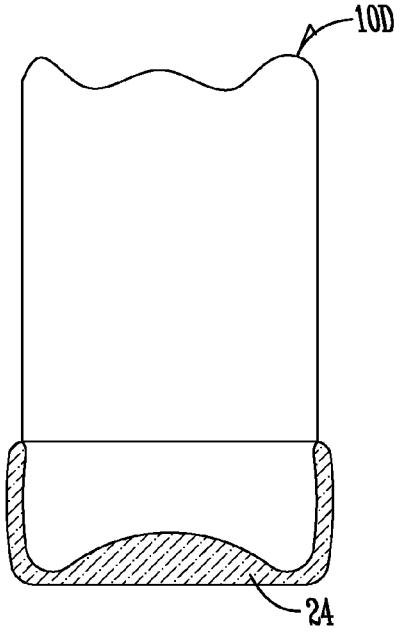
FIG. 5B is a cross-sectional view taken along line 5B in FIG. 5A.

The container 10D in FIGS. 5A and 5D includes a cup-type cover ingot 24 on the bottom of the container 10D.

Figure 6A:
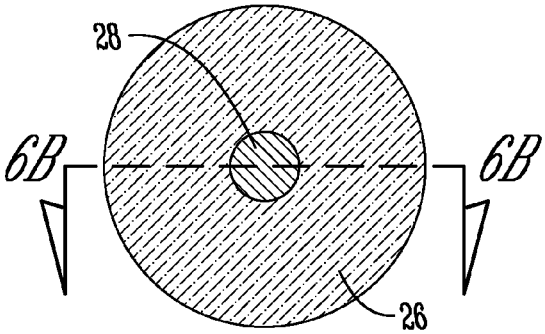
FIG. 6A is a bottom view of a container having an insulated cup type ingot with a metal center.
Figure 6B:
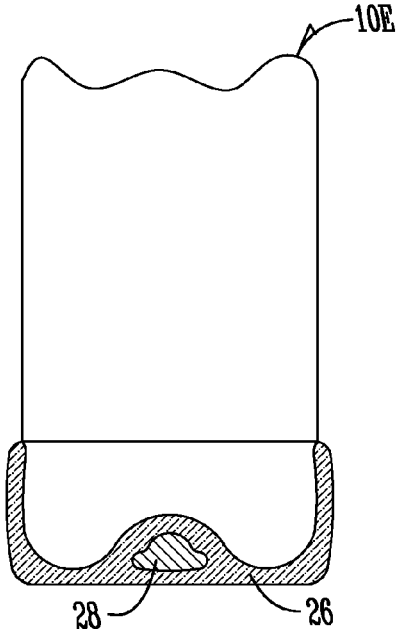
FIG. 6B is a cross-sectional view taken along the line 6B in FIG. 6A.

In FIGS. 6A and 6B, the container 10E has an insulated cup-type ingot 26 with a metal center 28. The cup ingot 26 can be of plastic material.

Figure 7:
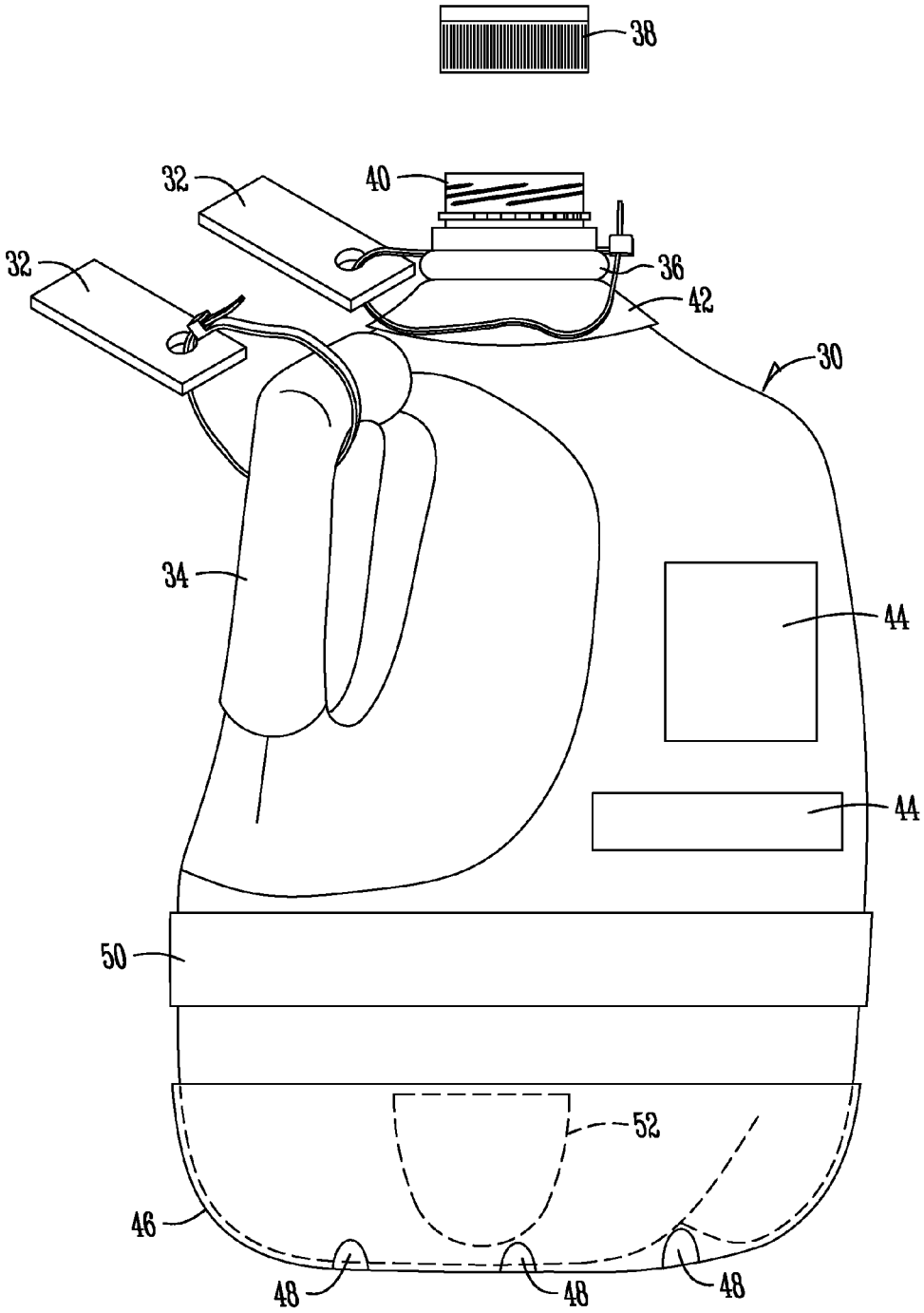
FIG. 7 is a side elevational view of a container illustrating the use of other types of ingots.

In FIG. 7, a large container 30 is shown to illustrate various other types of ingots that may be used to increase the value of the container 30 to encourage the user to recycle the container. One example is the use of zip tied ingots 32 attached to a handle 34 or the neck 36 of the container. The cap 38 may also function as an ingot as well as the collar 40 of the neck 36. A dress-type ingot 42 may be attached to the top of the container below the neck 36. Side ingots 44 are also optional. The handle 34 may also contain ingot material. The bottom of the container may be provided with a protective insulating cup-type ingot 46 and may include metal inclusions 48. A cylinder-type ingot 50 is shown embracing the container 30 below the handle 34. Inside the container 30 a loose agitation ingot 52 may be provided which will not only increase the value of the container but can aid in mixing the contents of the container. The ingot 52 may also be attached to the container internal side wall or bottom wall.

Figure 8:
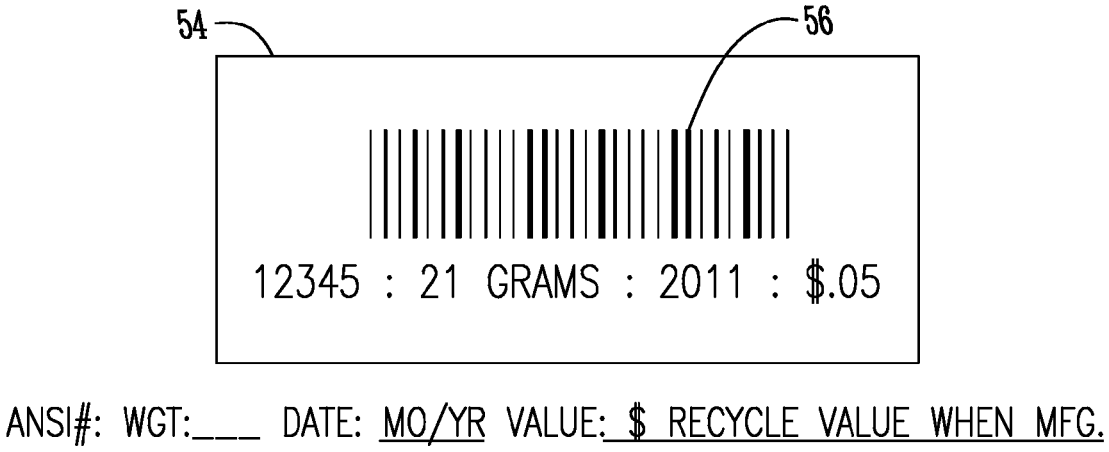
FIG. 8 is a bar code recycle label.

It is thus seen that the container manufacturer for beverages and other materials is provided with many choices for increasing the value of the container sufficiently to encourage the user to recycle the container. It is particularly important that the user have as much information has possible as to the foreseeable value of the container which if sufficient will motivate recycling. Thus in FIG. 8 a label 54 is shown including a bar code 56 which additionally includes printed information: ANSI composition, weight, date, and recyclable value. Other information such as the month and year of manufacture may be provided.

What is claimed is:

1. The method of recycling containers made of recyclable material comprising the steps of:

determining a market value of container material that will provide incentive to recycle a container from which the container will be manufactured;

determining the amount of material required to provide a container;

manufacturing the container from the material;

filling the container with product;

providing the container with supplemental material, said supplemental material comprising an ingot to enhance the incentive to recycle by increasing the value of the container;

wherein varying a size of said ingot controls the value of the container despite market value fluctuations;

attaching the ingot to the container;

transferring the container with product and attached ingot to a consumer;

the consumer producing an empty container with an attached ingot by consuming the product in the container; and the consumer presenting the empty container and ingot to the recycling center for payment based on the value of container material and supplemental material.

2. The method of claim 1 wherein the value of the container when presented to recycling center is the value of the material used in manufacturing the container.

3. The method of claim 1 wherein supplemental material is added to the container material at the time the container is being manufactured.

4. The method of claim 1 wherein the supplemental material is added to the container after manufacturing of the container.

5. The method of claim 1 wherein the supplemental material is the same as the container material.

6. The method of claim 1 wherein the supplemental material is dissimilar to the container material.

7. The method of claim 1 wherein the container material is metal.

8. The method of claim 1 wherein the container material is plastic.

9. The method of claim 1 wherein the container includes side and bottom walls and the supplemental material is attached to the bottom wall.

10. The method of claim 9 wherein the supplemental material is attached to the inside surface of the bottom wall.

11. The method of claim 9 wherein the supplemental material is attached to the outside surface of the bottom wall.

12. The method of claim 1 wherein the supplemental material is placed inside the container.

* * * * *